US007926672B2

(12) United States Patent
Ely

(10) Patent No.: US 7,926,672 B2
(45) Date of Patent: Apr. 19, 2011

(54) YOKE FOR A RAILWAY DRAFT GEAR AND METHOD OF MAKING

(75) Inventor: Sean Ely, Flemington, NJ (US)

(73) Assignee: Strato, Inc., Piscataway, NJ (US)

( * ) Notice: Subject to any disclaimer, the term of this patent is extended or adjusted under 35 U.S.C. 154(b) by 610 days.

(21) Appl. No.: 12/021,775

(22) Filed: Jan. 29, 2008

(65) Prior Publication Data

US 2008/0197096 A1 Aug. 21, 2008

Related U.S. Application Data

(63) Continuation-in-part of application No. 11/676,165, filed on Feb. 16, 2007, now abandoned.

(51) Int. Cl.
*B61G 9/00* (2006.01)

(52) U.S. Cl. ..... 213/67 R

(58) Field of Classification Search ..... 213/62 R, 213/63, 64, 67 R
See application file for complete search history.

(56) References Cited

U.S. PATENT DOCUMENTS

| | | | | | |
|---|---|---|---|---|---|
| 1,352,151 | A | | 9/1920 | Simonson | 213/67 R |
| 1,545,521 | A | | 7/1925 | Richardson | 213/67 A |
| 1,557,060 | A | | 10/1925 | Kadel | 213/67 A |
| 1,636,690 | A | | 7/1927 | Hawkes et al. | 213/71 |
| 1,921,011 | A | | 8/1933 | Spence | 213/67 |
| 1,951,318 | A | | 3/1934 | Barrows | 213/67 |
| 2,241,353 | A | | 5/1941 | Kinne et al. | 213/72 |
| 3,063,573 | A | | 11/1962 | Furniss | 213/67 |
| 3,708,076 | A | * | 1/1973 | Radwill | 213/67 R |
| 4,022,329 | A | | 5/1977 | Dilg | 213/67 R |
| 4,635,804 | A | | 1/1987 | Hanula | 213/67 R |
| 5,096,076 | A | | 3/1992 | Elliott et al. | 213/67 A |
| 5,221,015 | A | * | 6/1993 | Mautino et al. | 213/67 R |
| 5,246,135 | A | | 9/1993 | Radwill | 213/64 |
| 5,305,899 | A | | 4/1994 | Kaufhold | 213/50 |
| 5,320,229 | A | | 6/1994 | Mautino et al. | 213/67 A |
| 5,339,970 | A | | 8/1994 | Mautino et al. | 213/67 R |
| 5,511,676 | A | * | 4/1996 | Holmes | 213/67 R |
| 5,598,937 | A | | 2/1997 | Clark | 213/62 R |
| 6,796,448 | B1 | | 9/2004 | Wilt et al. | 213/40 R |

OTHER PUBLICATIONS

AAR Standard S-143, revised Jul. 2003.
AAR Standard S-149, revised Jul. 2003.

* cited by examiner

*Primary Examiner* — S. Joseph Morano
*Assistant Examiner* — Robert J McCarry, Jr.
(74) *Attorney, Agent, or Firm* — Fitzpatrick, Cella, Harper & Scinto

(57) ABSTRACT

Yokes utilized in railway coupling apparatus are designed according to the invention to have improved stress profiles and increased service life. Investment casting techniques used to make the yokes and other components of the coupling apparatus yield improved surface finishes and tighter dimensional tolerances of the parts without requiring hammering, coating or other post-casting treatment.

13 Claims, 5 Drawing Sheets

YOKE FOR A RAILWAY DRAFT GEAR AND METHOD OF MAKING

This application claims the benefit of U.S. application Ser. No. 11/676,165, filed Feb. 16, 2007.

BACKGROUND OF THE INVENTION

1. Field of the Invention

The present invention is directed to apparatus for coupling railway cars, and to methods of manufacture thereof. Specifically, features are described herein in connection with E-type and F-type yokes to provide improved stress profiles, leading to increased service life. Methods of making yokes and other components of the coupling apparatus, using investment casting techniques, are also described.

2. Description of Related Art

There are relatively few arrangements known for positioning railway draft gear between freight cars. In the United States, the arrangements commonly used are governed by standards set by the American Association of Railroads ("AAR"). In general, two cars in a freight consist are joined by heavy shafts extending from each car, known as couplers, and each coupler is engaged with a yoke housing a shock-absorbing element referred to as the draft gear.

Conventionally, the yoke is an elongated structure having two side sections extending from and joined by a tail portion. The side sections (sometimes referred to as "straps") are joined at the opposite end by a head portion where the yoke is joined to the coupler with a key or pin. The draft gear is positioned between the side sections of the yoke, and between the tail portion and the head portion. The best-known yokes are the E-type and F-type. The E-type yoke is governed by the AAR S-143 Standard, SY 40AE or YS93AE, for a 24⅝ inch gear pocket, referred to herein as the "S-143 standard," or simply as the "E-type standard." The F-type yoke is governed by the S-149 standard. The yokes differ primarily in the design and orientation of the pin or key used to join the coupler to the yoke, with respect to the railway car, although there are other significant differences.

The coupler is joined to the yoke by means of apertures in the head portion of the yoke, sometimes referred to as the key slot or pin bore, through which a key or pin is passed connecting the elements. When the train is in motion, the yoke is in tension, and compressive forces are transferred to bearing surfaces positioned at opposed ends of the yoke where the draft gear is housed. There may be a plate intermediate the yoke and the draft gear at the front side of the tail portion, and there is also usually a plate positioned proximate the head portion of the yoke, bearing force from the front of the draft gear.

In practice, the separation of railway cars in a freight consist allows for a specified yoke length. Depending on whether the yoke is E-type or F-type, the length may be 41⅛" or 37½" respectively, as defined by the applicable AAR standard. The side sections of a yoke are subjected to tension and can stretch over time causing the yoke to become difficult to remove from the car, due to deformations of the straps. Therefore, two challenges addressed by the present invention involve dimensioning the yoke so that it is (i) more resistant to stretching during use and (ii) more easily removed after being stretched in use.

Portions of the yoke that are subjected to concentrations of stress are also susceptible to cracking and failure over time. These areas include the front of the key slot in E-type yokes, and the area where the side sections join the tail portion. Thus, another challenge addressed by the invention is the dimensioning of the yoke so that it will meet the requirements of the standard AAR specification, while at the same time improving the stress profiles in these areas, as well as other areas of the yoke.

A still further object of the invention is the development of methods of manufacture that permit improvement in the dimensional tolerances of the yoke, which in turn allows the above described sophisticated design elements to be incorporated. These manufacturing techniques are also found to improve the surface finish of the components made.

E-type yokes are described and claimed in U.S. Pat. No. 5,096,076 and U.S. Pat. No. 5,511,676, both of which are incorporated herein by reference. The yoke according to the present invention is expected to provide an improved stress profile in response to applied tensile loads as compared to these prior art yokes.

SUMMARY OF THE INVENTION

In one aspect, the invention concerns the design of the tail portion of either F-type and E-type yokes. A yoke according to this aspect of the invention comprises: a tail portion at one end of the yoke and two opposed sections extending from the tail portion and terminating in a head portion. The head portion comprises opposed top and bottom walls and opposed supporting walls substantially perpendicular to the top and bottom walls. Depending on whether the key or pin is oriented vertically (as in an F-type yoke), or horizontally (as in an E-type yoke), the top and bottom walls, or the opposed supporting walls, have opposed apertures to receive a corresponding pin or key for engaging a railway car coupler. The opposed side the sections meet the tail portion at respective relief fillets. Each relief fillet has a substantially identical compound radius of curvature, such that a first portion of the compound radius is farther from a centerline of the yoke and has a radius of about ½ inch to about 1 inch, tapering to a second portion of the compound radius, nearer to the centerline of the yoke, and having a radius of about ½ inch to about 2 inches.

Similar relief fillets may be provided where the side sections meet the key slot walls at the head portion of an E-type yoke.

In most prior art E-type yokes, the side straps taper inward (toward a horizontal plane on the centerline of the yoke) to form a narrower head portion. In a preferred embodiment according to the present invention, the opposed side sections are parallel along their entire length.

It has been found that the sharp radius of curvature at the front portion of the nose of an E-type yoke causes undesirable stresses. This is improved according to the present invention by providing a forward surface of the key slot defined by a first arc (which is standard in the industry), and wherein the forward peripheral surface of each supporting wall is defined by a second arc, said second arc extending from opposite sides of the forward end of the respective key slot. An appropriate soft curvature at the nose portion is found when the centers of curvature of the first arc and of the second arc are coincident.

In preferred embodiments, the tail portion of the yoke is provided with a rear peripheral surface forming at least one concave cut out. In a preferred embodiment, these cutouts are smooth generally "U" shaped grooves.

In preferred embodiments, the key slot wall has a flat, uniform appearance, free of concavities, and does not include a reinforcing rib adjacent the key slot.

Whereas the straps of a conventional E-type yoke have a standard width of 5 inches, the inventors herein have proposed wider straps, 5¾ inch at the narrowest point, like an F-type yoke.

The invention also includes a railway car coupling component having superior dimensional tolerances and better surface finish and method for making such improved component. It is contemplated that the method may be applied to the manufacture of a yoke or a knuckle element, used to join the couplers. The investment casting technique of the invention comprises first forming a destructible prototype of the component, and coating the prototype to form a temporary mold. The temporary mold is built up with several layers. Thereafter, the prototype is removed from the temporary mold, the component is cast in metal (including but not limited to steel) in the temporary mold, and the temporary mold is destroyed. It is believed that investment casting techniques have not previously been used to cast railroad coupling components. The investment casting technique results in tighter tolerances, such that components made by the process have dimensions within ±3% of a design dimension, preferably within ±1% of a design dimension, and a smooth surface finish, with little or no hammering or finish grinding required. Such dimensional precision and surface finish cannot be obtained using conventional green sand casting techniques.

DETAILED DESCRIPTION OF THE PREFERRED EMBODIMENTS

As used herein, directions are relative to the normal orientation of a railway car. Thus, "horizontal" means generally parallel to the earth, and vertical is the perpendicular direction. "Up" and "top" are in the direction of the sky. The words "forward" and "front" refer to the direction toward the head portion of the yoke, while "tail" and "rear" refer to the opposite direction. Note that the "fronts" of two yokes on two adjacent rail cars face each other. "E-type" and "F-type" are used to refer to types of yokes generally, without reference to the details of a particular AAR standard. One of ordinary skill in the art will readily understand that an "E-type" yoke according to the invention may depart slightly from the AAR standard, and still be recognizable as an E-type yoke by virtue of the horizontal orientation of the draft key, whereas an F-type yoke is recognized by the vertical orientation of the pin. Where reference is made herein to a specific AAR standard, the reference is to the AAR standard in effect at the time of filing of this application. Where specific dimensions are given in the present description, it will be understood that tolerances are permitted. One of ordinary skill in the art will understand that a given dimension of less than 4 inches is typically permitted a tolerance of about ±1/16 inches; a dimension of 4 inches to 24 inches is typically permitted a tolerance of about ±3/32 inches; and a dimension of more than 24 inches is typically permitted a tolerance of about ±⅛ inch.

Figure 1:
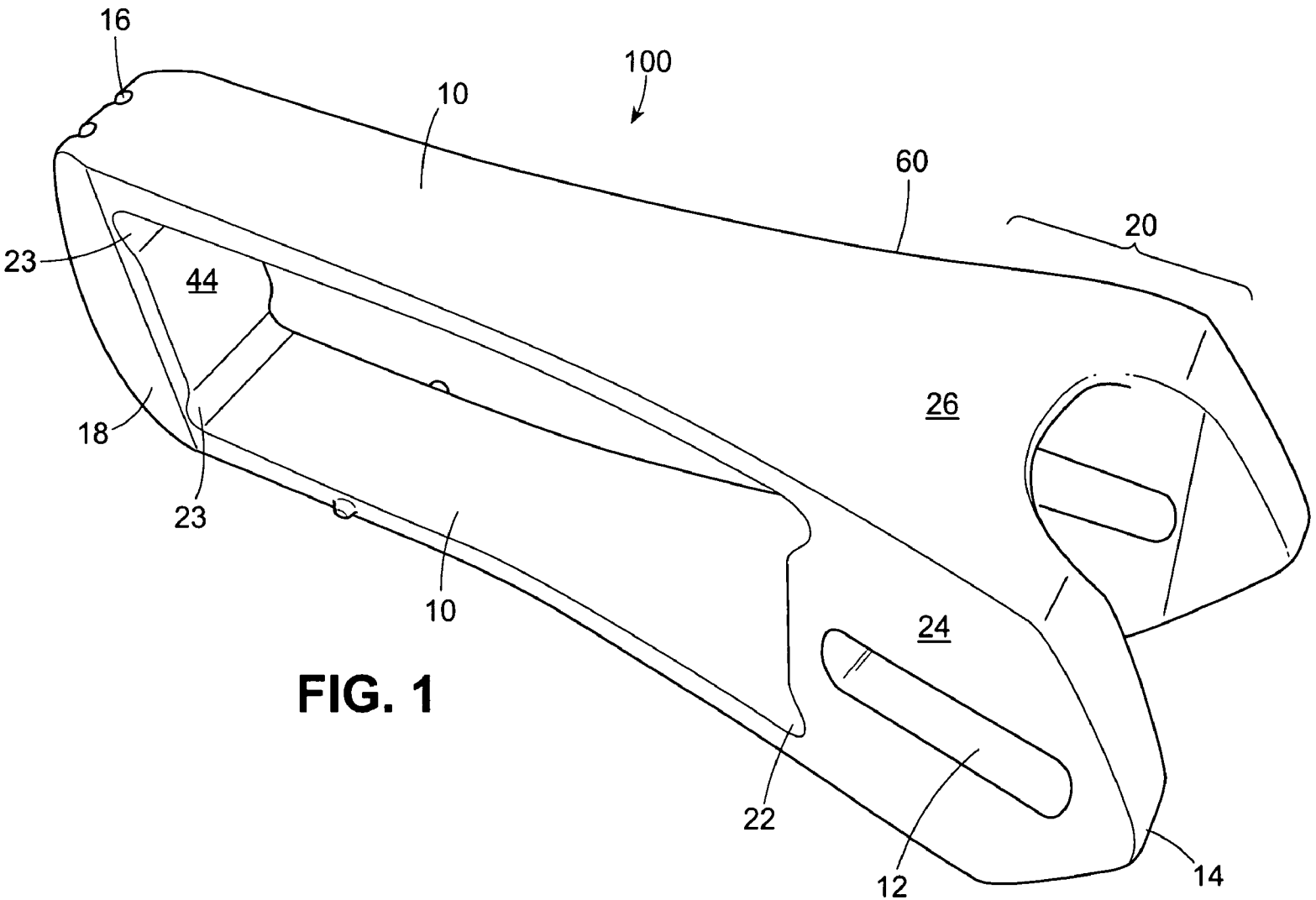
FIG. 1 is a perspective view of an E-type yoke according to the invention.

As shown in FIG. 1, yoke 100 comprises sections 10 extending from tail portion 18 to head portion 20. The head portion 20 comprises opposed supporting walls 24 and opposed top and bottom walls 26. In the case of the E-type yoke of FIG. 1, the supporting wall 24 may be referred to as a key slot wall. The side sections 10 meet the tail portion 18 at rear relief fillets 23, and the side sections meet the key slot walls 24 at the front relief fillets 22. The head portion 20 refers to the part of the yoke forward of the front relief fillets 22.

Figure 5:
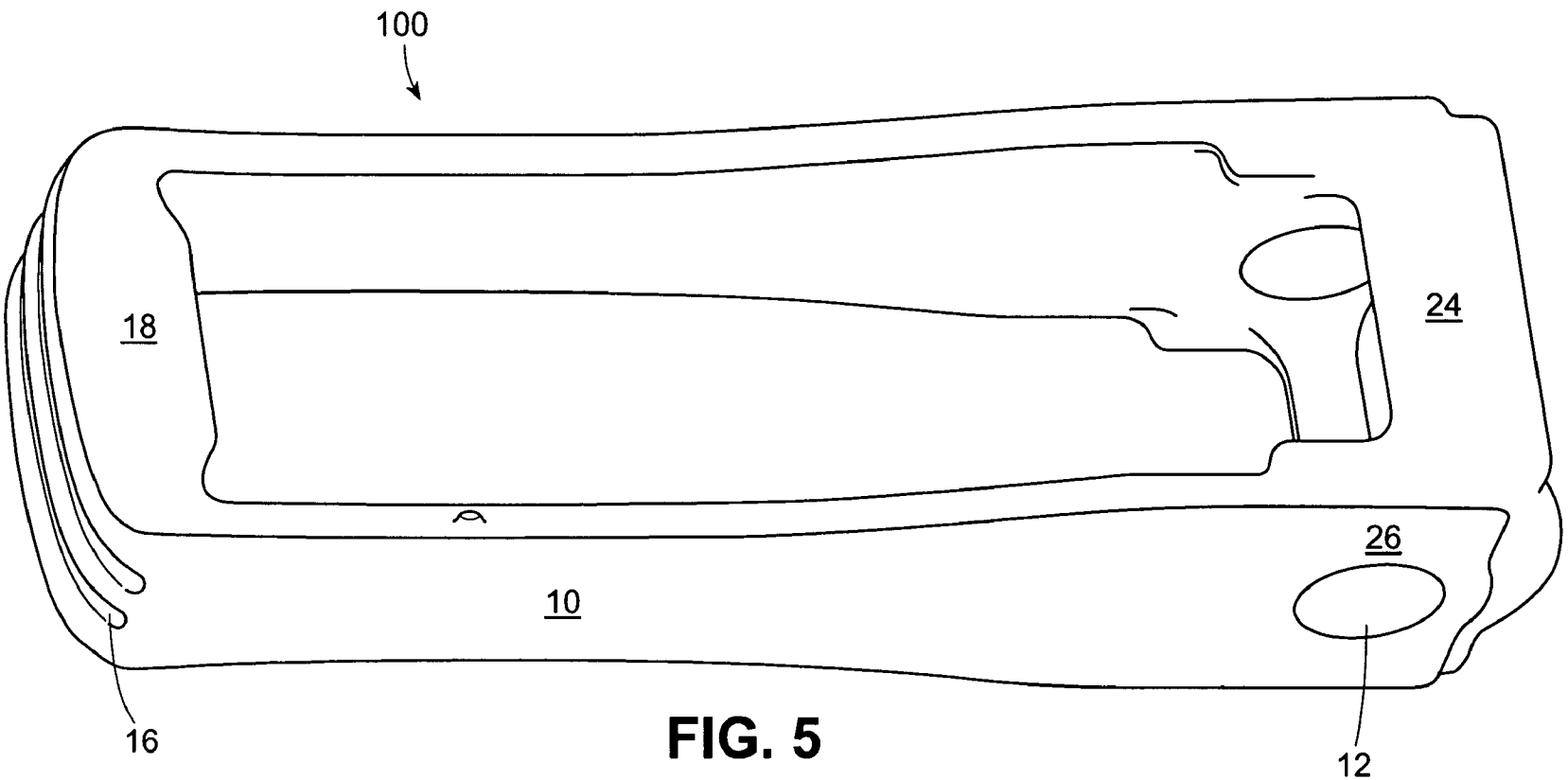
FIG. 5 is a perspective view of an F-Type yoke according to the invention.

An F-Type yoke is depicted in FIG. 5. In this type of yoke, the apertures 12 (sometimes called pin bores), are oriented vertically in use, and they are located in the top and bottom walls 26, not in the supporting walls 24.

In one aspect of the invention, an E-type yoke is provided having a shortened distance of less than 3 inches (preferably 2½ inches) between the front of the key slot 12 and the forward peripheral surface 14 of the yoke. The reduced distance is obtained, without providing additional thickness around the key slot and while retaining satisfactory strength and rigidity, by forming the forward peripheral surface 14 in a continuous arc at the nose portion which has a center of curvature coincident with the center of curvature of an arc defining the front of the key slot. This is shown in FIG. 2, wherein the forward peripheral surface of each supporting wall (sometimes referred herein to as the "key slot wall" in an E-type yoke) is defined by an arc having a center of curvature coincident with the center of curvature of an arc defining the front surface of the key slot.

Figure 4:
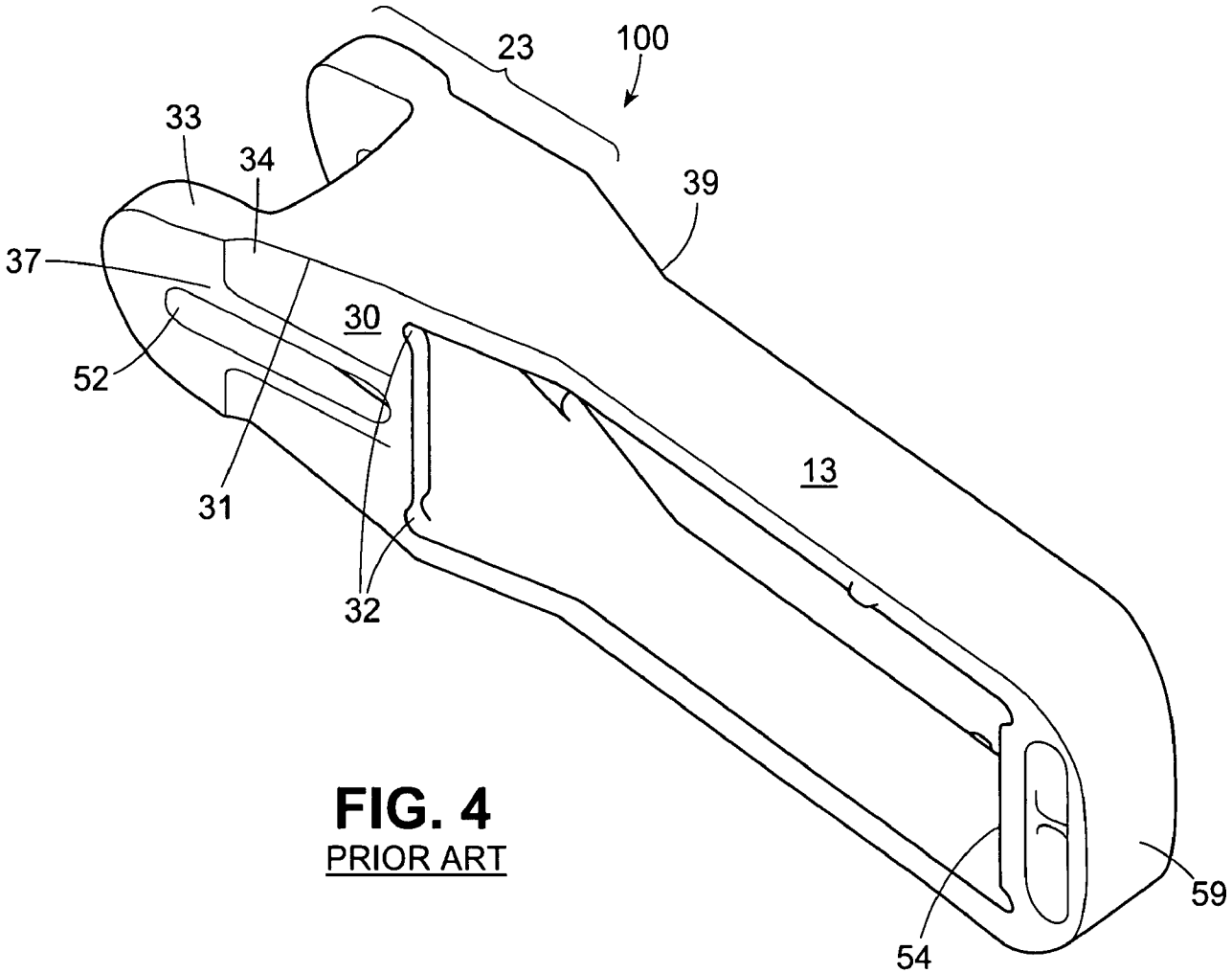
FIG. 4 PRIOR ART
FIG. 4 is an E-Type yoke according to the prior art.

In the prior art, shown in FIG. 4 and described in U.S. Pat. No. 5,096,076, the side straps 13 taper from the widest distance separating the straps, beginning to taper approximately where the head portion 23 begins at the front relief fillets 32 toward the centerline of the yoke. The curved nose portion 33 therefore spans a narrower portion, which results in a smaller radius for the nose portion of the key slot wall.

Figure 2:
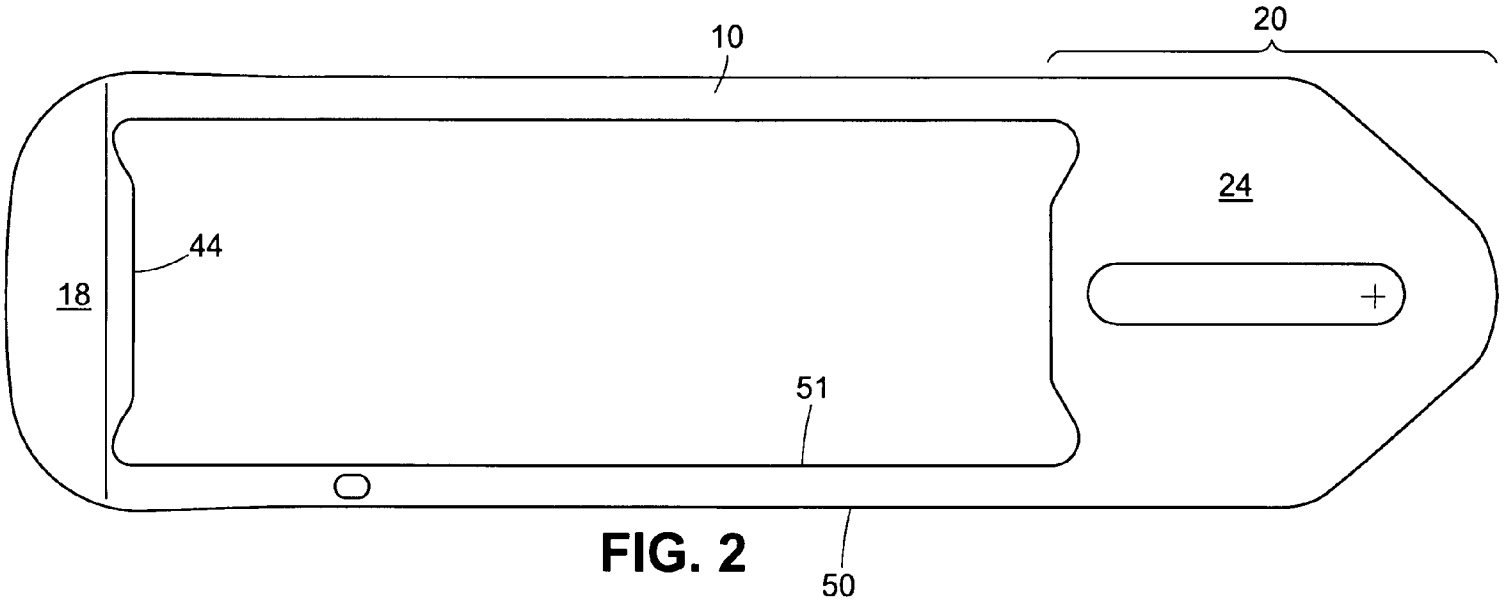
FIG. 2 is a side elevation view of the E-type yoke of FIG. 1.

According to the preferred embodiments of the present invention, the straps are parallel along their entire length, as best seen in the side elevation view of FIG. 2.

Conventionally, E-type yokes have had side straps with a width of about 5 inches, while F-type yokes have wider straps, with a width of 5¾ inches. According to the present invention, yokes having key slot walls perpendicular to the side straps (i.e., E-type yokes) preferably have side sections 10 with a narrowest width $W_1$ of about 5¾ inches at the narrowest portion, tapering to a width of about 10⅞ inches at the widest point $W_2$, where sections 10 form opposed walls 26 of the head portion 20, although these dimensions are not critical. The most preferred length of an E-type yoke according to the invention is 40⅝ inches. The forward peripheral surface 27 of the side sections 10 is preferably concave. The wider straps increase strength and service life of the yoke.

Figure 3:
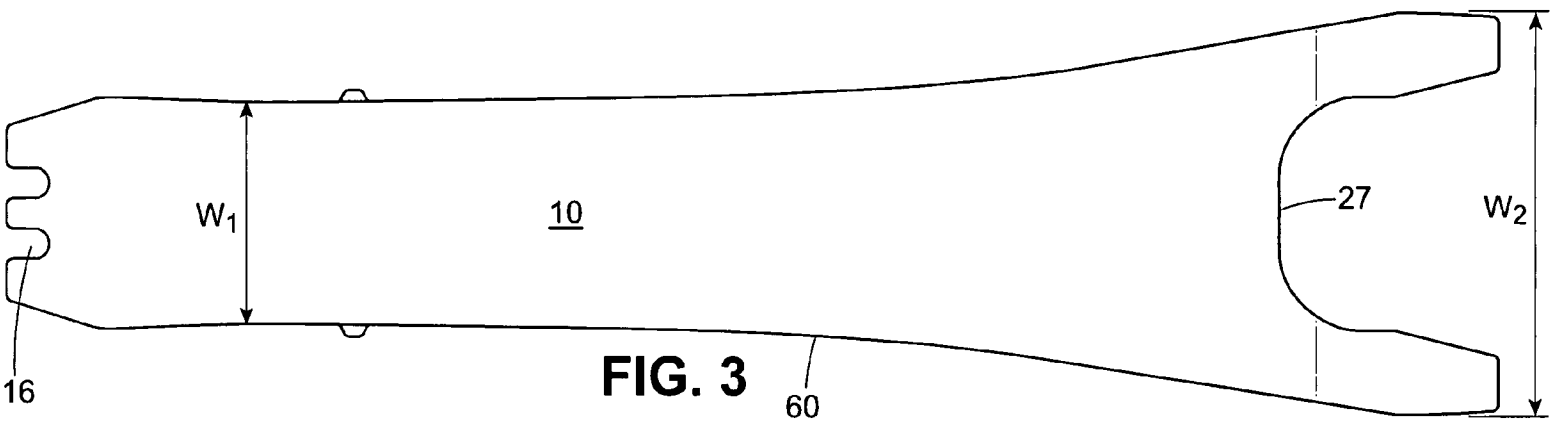
FIG. 3 is top plan view of the E-type yoke of FIG. 1.

In the prior art, the edges of the straps defining the width extend from the tail portion equidistantly from each other, and then at a point, indicated with numeral 39 in FIG. 4, the edges abruptly taper away from each other to form the head portion. The radius of curvature at this point in the prior art is on the order of 2 inches to 3 inches. This causes a stress concentration at the point where the edges begin to taper outward to meet the head portion. It is preferable, according to the present invention, to provide the edges of the straps with a gradual taper. As shown in FIG. 3, the edges of sides 10 are described by a gradual taper having a radius of curvature greater than about 10 inches, preferably greater than about 20 inches, and in the most preferred embodiment, in a range of about 60 inches to about 70 inches, at the most sharply curved portion.

Another aspect of the invention involves designing the tail portion of the yoke to achieve smoother stress distributions and weight reduction for the yoke overall. Although it is conventional to provide cut outs in the tail portion to reduce the weight of the yoke, this has conventionally been done by providing recessed cavities in the sidewalls of the tail portion, so that the rear surface presents a substantially flat wall. It has now been found that providing a rear peripheral surface comprising a plurality of grooves, for example, two smooth generally "U"-shaped grooves 16 in tail portion 18, as shown in FIG. 3, improves the stress profile in the tail portion.

Figure 6B:
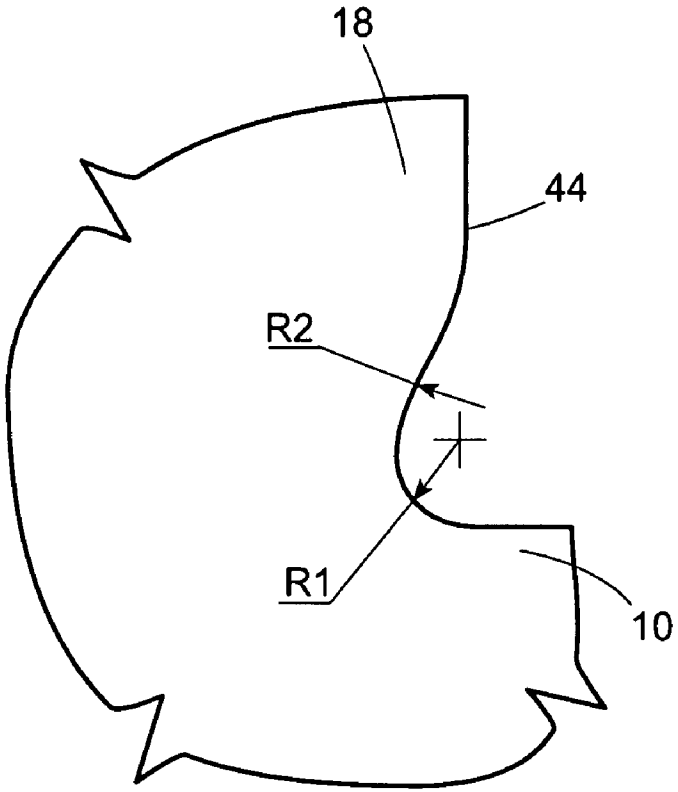
FIG. 6*b* is a detail of a relief fillet at the tail portion of the yoke of FIG. 1.
Figure 6A:
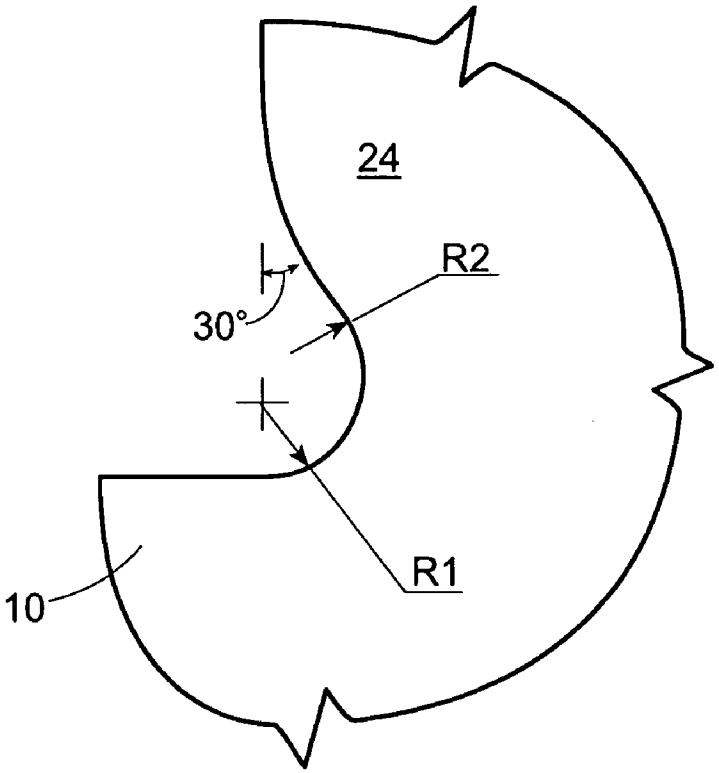
FIG. 6*a* is a detail of a relief fillet at the head portion of the yoke of FIG. 1.

Yet another aspect of the invention involves modifications at the relief fillets 22, 23, the areas where the side section 10 join the head portion 20 and the tail portion 18. As shown in FIG. 1, sections 10 meet the tail portion at rear relief fillets 23, shown in the detail of FIG. 6*b* and the side sections 10 join the key slot walls at front relief fillets 22, shown in the detail of FIG. 6*a*. In a conventional yoke, the area where the straps meet the tail portion is subject to high stress. The problem has conventionally been addressed with a relief fillet, standardized according to AAR Standard S-139. According to the S-139 Standard, a relief fillet is formed as a groove having a radius of ½ inch beginning just in front of the tail portion and extending into the tail portion.

It has now been found that the stress profile at this critical part of the yoke can be improved by providing relief fillets having compound radii. The first part of the compound radius of each fillet, the part closer to the strap, has a smaller radius R1, and the second part of the compound radius, toward the center line of the yoke (in an E-type yoke), has an increased radius R2 with respect to radius of the first part. The larger part of the compound radius, which results in a more gradual taper from the rear fillet 23 to the rear surface 44 of the draft gear pocket preferably has a radius at least twice as large as the radius of the part of the fillet closer to the section 10. It is preferred that the more sharply curved portion of the compound radius in the relief fillet has a radius of curvature in a range of about ½ inch to about 1 inch, and the radius of the larger radius in the compound radius is in a range of about ½ to about 2 inches. As a non-limiting example, the first part of the compound radius is preferably on the order of about ½ inch, while the second part is on the order of 2 inches. An important aspect of the improved relief fillet according to the invention is that the transition from the smaller radius to the front wall of the tail portion is gradual rather than abrupt. The same features can be beneficially incorporated into the front relief fillet 23 where the straps meet the key slot wall 24 of the head portion 20.

The generally smooth contours described above in connection with the various improved design features of the yoke are achievable at least in part because the method of manufacture of the yoke has been improved. Large steel castings such as a yoke have conventionally been made by green sand casting, in which a mold is made in sand, and the pieces are individually cast.

According to the invention, a railway car coupling component is made by forming a destructible prototype of the component in a destructible media, for example in wax, expanded foam plastic, other destructible plastic, or even ice. The prototype is coated with a semi-permanent coating, for example a porcelain slurry, to form a temporary mold. The temporary mold is built up with several layers. The prototype can be removed from the temporary mold and the component may be cast in the mold in steel or other suitable high tensile strength metal. This procedure, known as investment casting, has not previously been used to manufacture railroad coupling components. Nevertheless, it has been found that castings using this technique yield components having better dimensional tolerances, such as within ±3% of a design dimension, with reduced need for hammering or finish grinding. Many of the features described herein, including the gradual taper of the edges of sections 10, the rounded forward peripheral surface 14 of the key slot wall, the generally "U" shaped cutout 16, and the smooth tapering of the relief fillets 22, 23, are made possible by the novel application of the investment casting process to the manufacture of railroad coupling parts. In many cases, the investment cast coupling components have a smooth surface finish, without requiring any finish grinding.

Typically, railroad coupling components are made of steel, and casting would be performed with steel. However, steel alloys, and other suitable metals and metal alloys are also contemplated. Yokes having a weight of 190 lbs or greater may be made according to the invention, which is surprising, as investment casting is normally used with lighter parts. It is contemplated that knuckles, which are used to join couplers, could also be made using this technique. Knuckles typically have a weight of about 70 lbs, or greater. After the component is cast, the temporary mold is destroyed.

Example

Stress analysis was performed on a yoke design according to the invention, and according to the prior art, modeled using Ansys® Workbench™ finite element analysis design software, Version 10.0, available from Ansys, Inc., Canonsburg, Pa. Using this software, a yoke according to the invention, substantially as shown in FIG. 1, and a yoke according to the prior art, substantially as shown in FIG. 4, were subjected to a loading that is typical of what is expected in service. In the computer model, a static tensile load of 300,000 lb in a longitudinal direction was applied at the front walls 12 and 52 of the respective keyslots, while the yoke was constrained at the respective rear surfaces 44 and 54 between the respective relief fillets. The equivalent (von Mise) stresses obtained are tabulated in Table 1. The stress was measured at the front relief fillets, at the rear relief fillets, at the front of the key slot, and at the rear of the key slot. Additionally, stress was measured at a point on the straps where the edges taper outward to the head portion, approximately at the position shown as 60 in FIG. 1 and as 39 in FIG. 4. Stress on the nose portion was measured where the curved nose portion begins in each case, in the concave area about at the point labeled 34 in FIG. 4, and about at the point labeled 64 in FIG. 1.

TABLE 1

| Yoke Stress (KSI) | | |
|---|---|---|
| Location | Invention | Prior Art |
| Rear relief fillet | 70 | 100 |
| Front relief fillet | 73 | 83 |
| Front of key slot | 60 | 68 |
| Rear of key slot | 110 | 110 |
| Side section | 20 | 45 |
| Nose portion | 10 | 85 |

The model showed that the yoke according to the invention exhibited a significant reduction in stress at most of the critical areas where stress was measured, as compared to the prior art (the exception being the rear of the key slot where significant reduction in stress was not observed in the computer model). Stresses calculated from strain measurements performed on actual yokes subjected to tensile forces confirmed the accuracy of the computer modeling, at least in terms of relative values for stress reduction, if not in absolute stress measurements.

Based on computer modeling, it is believed that a rear relief fillet having a compound radius will exhibit a reduced stress profile in that area in response to a 300,000 lb tensile load applied to the yoke as set forth in the above example. A compound radius having a first part closer to the strap, with a radius in a range of about ½ inch to about 1 inch, and a second part of the radius at least twice the size of the first part of the radius so that the fillet meets the rear wall of the draft gear pocket with a gradual taper, will exhibit stress at least about 15 percent lower, preferably about 30 percent lower, than obtained for a similar yoke subjected to a similar load having rear relief fillets with a simple (non-compound) ½ inch radius. These reductions in stress are intended to be measured using finite element analysis software, as set forth in the above example.

Using the same criteria, a significant reduction in stress is noted in the side section at the most sharply curved point where the edges of the straps taper outward to meet the head portion. If the taper of the straps is made gradual, so that the edge of the strap is defined by an arc having a radius of curvature between 60 inches and 70 inches, as shown in FIG. 1, as opposed to the more abrupt transition shown in the prior art of FIG. 4, then the straps exhibit a stress of at least about 25% less under the same tensile load, preferably the stress reduction is 50% or more, compared with the prior art.

Stresses in the nose portion can be kept the same or even lowered, with respect to the prior art, even while a distance from the front peripheral surface to the front of the key slot is reduced (to 2½ inches in the most preferred embodiment), by utilizing the design criteria set forth herein.

The foregoing description is intended to be illustrative and not limiting of the invention, which is defined by the appended claims.

What is claimed is:

1. A yoke for a railway car coupling apparatus, comprising:

a tail portion at one end of the yoke;

two opposed sections extending from the tail portion and terminating in a head portion;

the head portion comprising opposed top and bottom walls and opposed supporting walls between the top and bottom walls and substantially perpendicular to the top and bottom walls;

wherein the top and bottom walls, or the opposed supporting walls, have an aperture to receive a post or key for engaging a railway car coupler;

wherein the sections meet the tail portion at respective relief fillets, each relief fillet having a substantially identical compound radius of curvature, such that a first portion of the compound radius is farther from a centerline of the yoke and has a radius of about ½ inch to about 1 inch, tapering to a second portion of the compound radius, nearer to the centerline of the yoke, and having a radius of about ½ inch to about 2 inches, and wherein the second portion of the compound radius is larger than the first portion of the compound radius.

2. The yoke of claim 1, wherein the ends of the opposed sections extending from the tail portion form the top and bottom wall of the head portion, and each of said top and bottom wall comprises a substantially identical circular pin bore.

3. The yoke of claim 1, wherein the supporting walls are substantially perpendicular to the opposed sections extending from the tail portion, and each supporting wall comprises a substantially identical elongated key slot.

4. The yoke of claim 3, wherein the opposed sections are parallel to each other for their entire length.

5. The yoke of claim 3, wherein the surface of the supporting wall is free of raised reinforcing portions or depressions in the vicinity of the key slot.

6. The yoke of claim 3, wherein the width of the opposed sections is 5¾ inches at the narrowest point.

7. The yoke of claim 3, wherein the forward surface of the key slot is defined by a first arc, and wherein the forward peripheral surface of each supporting wall is defined by a second arc, said second arc extending from opposite sides of the forward end of the key slot, and wherein the centers of curvature of the first arc and of the second arc are coincident.

8. The yoke according to claim 3, wherein the distance from the forward end of the key slot to the forward end of the peripheral surface of the supporting wall is in a range of 2½ inches to 3 inches, measured from the front of the arc to the front of the key slot.

9. The yoke according to claim 3, wherein each of the opposed sections has a width of about 5¾ inches at the narrowest part, and gradually and continuously widens to the head portion, said taper having a radius of curvature greater than about 10 inches at its most sharply tapered portion.

10. The yoke according to claim 1, wherein the rear peripheral surface of the tail portion comprises a plurality of concave generally "U" shaped grooves.

11. A yoke for a railway car coupling apparatus, comprising:

a tail portion at one end of the yoke;

two opposed sections extending from the tail portion and terminating in a head portion;

the head portion comprising opposed top and bottom walls and opposed supporting walls substantially perpendicular to the top and bottom walls;

wherein the top and bottom walls, or the opposed supporting walls, have an aperture to receive a post or key for engaging a railway car coupling apparatus;

wherein the tail portion has a rear peripheral surface forming at least one concave cut out.

12. The yoke of claim 11, wherein the top and bottom walls each comprise a substantially identical circular pin bore.

13. The yoke of claim 11, wherein the supporting walls each comprise substantially identical elongated key slot.

* * * * *